US005699100A

United States Patent [19]

Fukuda et al.

[11] Patent Number: 5,699,100

[45] Date of Patent: Dec. 16, 1997

[54] DIRECT COLOR THERMAL PRINTING METHOD

[75] Inventors: Hiroshi Fukuda; Toshiaki Fujimaki; Kazuo Miyaji, all of Saitama, Japan

[73] Assignee: Fuji Photo Film Co., Ltd., Kanagawa, Japan

[21] Appl. No.: 389,156

[22] Filed: Feb. 15, 1995

[30] Foreign Application Priority Data

Feb. 16, 1994 [JP] Japan ..... 6-019657

[51] Int. Cl.[6] ..... B41J 2/32; B41M 5/28

[52] U.S. Cl. ..... 347/175; 347/186

[58] Field of Search ..... 347/175, 188, 347/186; 400/120.09, 120.03, 120.08

[56] References Cited

U.S. PATENT DOCUMENTS 4,636,810 1/1987 Asakura et al. ..... 347/188

4,734,704 3/1988 Mizutani et al. .

4,872,772 10/1989 Tsukamoto ..... 347/188

*Primary Examiner*—Huan H. Tran

[57] ABSTRACT

A direct color thermal printing method supplements coloring density in a print start area for each color frame of a full-color image to be printed in a three color sequential fashion. A color thermosensitive recording sheet has cyan, magenta and yellow thermosensitive coloring layers formed on a base in this order. The heat sensitivities of the coloring layers become the lower the nearer to the base. Since the coloring density tends to be insufficient in the beginning of printing due to the temperature of the thermal head, supplementary drive pulses for supplementing coloring density is applied to each heating elements in addition to drive pulses for coloring. The supplementary heat energy is predetermined to be lower, the higher the line number from a print start position of the print area, and the higher the heat sensitivities of the thermosensitive coloring layers.

14 Claims, 10 Drawing Sheets

DIRECT COLOR THERMAL PRINTING METHOD

BACKGROUND OF THE INVENTION

1. Field of the Invention

The present invention relates to a direct color thermal printing method, especially for improving density rising characteristics in the beginning of printing of each color.

2. Description of the Background Art

With the direct color thermal printing method, a color thermosensitive recording sheet is directly heated to develop colors. The density of an ink dot recorded in one pixel changes with heat energy applied from a thermal head to the color thermosensitive recording sheet. For example, the color thermosensitive recording sheet is wound around a platen drum and the thermal head is pressed against the color thermosensitive recording sheet on the platen drum while the platen drum is rotated. The platen drum makes three revolutions per one sheet, and the thermal head records one color frame on the color thermosensitive recording sheet during one revolution so as to create three color sequential printing.

As disclosed, for example, in U.S. Pat. No. 4,734,704 (corresponding to JPA 61-213169), a color thermosensitive recording sheet has a magenta thermosensitive coloring layer, a cyan thermosensitive coloring layer, and a yellow thermosensitive coloring layer, respectively formed on a base in this order. To record an ink dot in a pixel, a coloring heat energy is applied from each heating element of the thermal head. The coloring heat energy is a sum of a heat energy having a level immediately before coloring (hereinafter called a bias heat energy which is changed with color) and a heat energy for coloring at a desired density (hereinafter called an image heat energy). The thermal head has an array of heating elements which are aligned in a main scan direction, whereas the color thermosensitive recording sheet is moved in a subsidiary scan direction perpendicular to the main scan direction, relative to the thermal head, so as to print each color frame one line after another.

In the color thermosensitive recording sheet, the lower the thermosensitive coloring layer, the lower the heat sensitivity. As a result, density rising characteristics are inferior in the beginning of printing, especially in coloring the lower- or innermost coloring layer, e.g., the cyan coloring layer. Because of the difference in density rising curves between the three coloring layers, the gray balance also tends to be deteriorated in the leading end portion of a print area. Therefore, it has been difficult to achieve an optimum color reproduction in the print start area or the leading end portion of the print area.

SUMMARY OF THE INVENTION

It is a primary object of the present invention to provide a direct color thermal printing method which improves density rising characteristics in the beginning of printing to obtain a print area having sharp edges and desired coloring densities uniformly over the whole area.

It is another object of the present invention to achieve an optimum gray balance even in the print start area wherein gray balance tends to be lowered due to the difference of the density rising characteristics between the coloring layers.

A further object of the present invention is to provide a method of effectively eliminating a color registration shift in the direct color thermal printing method.

In order to achieve the above and other objects of the present invention, a color thermal printing method is provided in which supplementary heat energy is applied to every heating element in a print start area of a print area in addition to standard coloring heat energy. The supplementary heat energy compensates for the insufficient thermal response of the heating elements in the beginning of the printing of each color. According to the present invention, the supplementary heat energy decreases along the subsidiary scan direction in accordance with a function predetermined for each coloring layer such that the lower the heat sensitivities of the coloring layers, the larger the supplementary heat energy with respect to the same position of the print area in the subsidiary scan direction. Therefore, a desired density can be obtained from the start of printing in all of the three colors, thus gray balance will not be deteriorated in the print start area.

According to a preferred embodiment of the invention, a thermal head is pressed against the sheet while being preheated in a preliminary running section preceding the print area. The length of the preliminary pressed running section and a heat energy for the preheating in the preliminary pressed running section are changed with each color. According to this embodiment, not only is a color registration shift eliminated, but also the printing operation starts in a thermal equilibrium state. Therefore, the less amount of supplementary heat energy is necessary for the above-described density rising correction, thereby ensuring a stable correction even if there is a large change in circumferential conditions or a large mechanical variation of the printer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENTS

Figure 1:
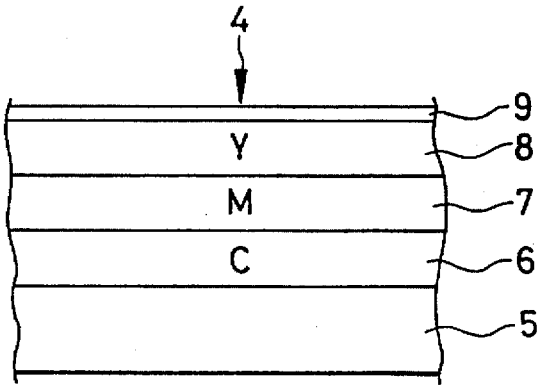
FIG. 1 is an explanatory view of the construction of a color thermosensitive recording sheet.

FIG. 1 shows an example of a color thermosensitive recording sheet 4 for use in the present invention, which has a layer structure having a base 5 and a cyan thermosensitive coloring layer 6, a magenta thermosensitive coloring layer 7, a yellow thermosensitive coloring layer 8 and a protective layer 9 formed on the base 5 in this order from the bottom. The thermal recording of these coloring layers 6 to 8 is performed in the order from the top. If thermal recording is to be performed in the order of magenta, yellow and cyan, the yellow and magenta thermosensitive coloring layers are interchanged in layer position. A four layer structure may be used by adding a black thermosensitive coloring layer.

Figure 2:
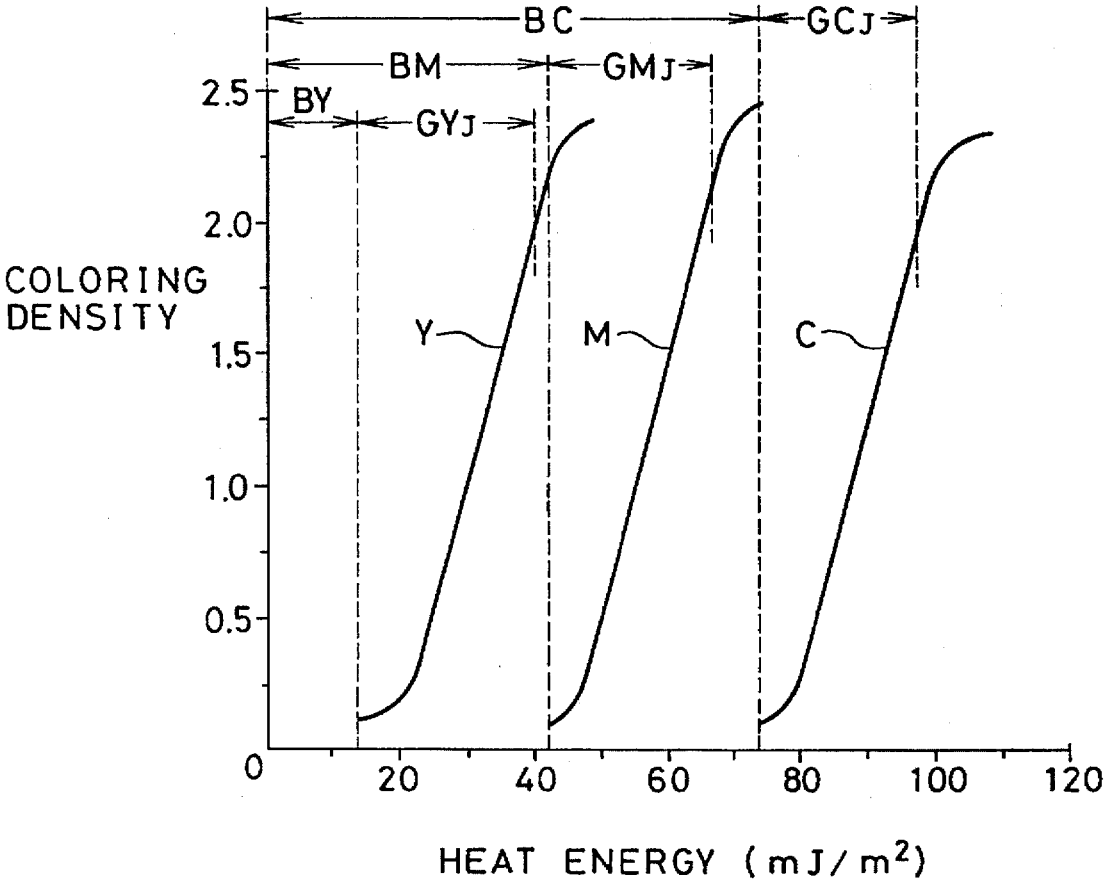
FIG. 2 is a graph showing the coloring characteristics of the color thermosensitive recording sheet.

As shown in FIG. 2, the deeper the thermosensitive coloring layer is positioned, the higher the coloring heat energy. Accordingly, the yellow thermosensitive coloring layer 8 requires a smallest heat energy for coloring, whereas the cyan thermosensitive coloring layer 6 requires a largest heat energy for coloring. As for the yellow thermosensitive coloring layer 8, the coloring heat energy applied thereto is a sum of a constant bias heat energy BY and an image heat energy GYj determined by a gradation level "J" of each pixel. The bias heat energy BY has such a level that the yellow thermosensitive coloring layer 8 is about to be colored. Also, the coloring heat energy for the magenta or the cyan coloring layer 7 and 6, is a sum of a constant bias heat energy BM or BC and an image heat energy GMj or GCj, respectively.

Figure 3:
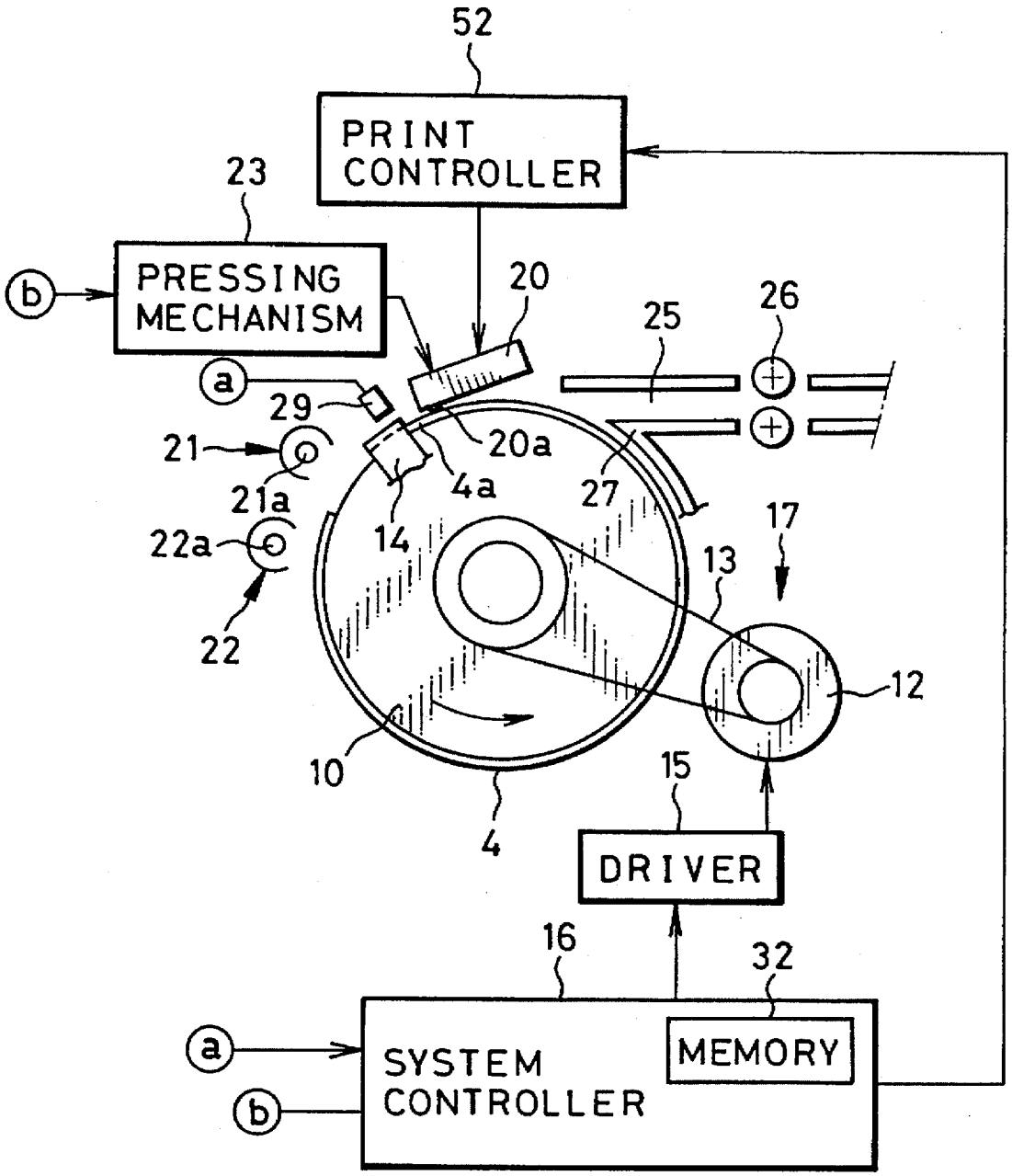
FIG. 3 is a schematic view of a direct color thermal printer embodying the present invention.

FIG. 3 shows a direct color thermal printer used with a method according to a preferred embodiment of the invention. A platen drum 10 holds the color thermosensitive recording sheet 4 on the outer circumference thereof to feed it in the subsidiary scan direction. The platen drum 10 is rotated by a pulse motor 12 through a belt 13 during the thermal recording. The color thermosensitive recording sheet 4 is clamped by a clamper 14 at its leading portion 4*a* relative to the platen drum 10. The pulse motor 12 is controlled by a system controller 16 through a motor driver 15. The system controller 16 generates motor drive pluses such that the platen drum 10 is rotated one-line amount by applying four motor drive pulses to the pulse motor 12. The platen drum 10, the pulse motor 12, the belt 13, the clamper 14 and a pair of feed rollers 26 mounted in a sheet feed/discharge path 25 constitute a recording sheet feed system 17.

A thermal head 20 and first and second optical fixing devices 21 and 22 are sequentially disposed along the outer circumference of the platen drum 10. The thermal head 20 is provided with an array of heating elements 20*a* which extends in a main scan direction, and is pressed against the color thermosensitive recording sheet 4 by a pressing mechanism 23 when printing. The pressing mechanism 23 is constituted of, for example, a solenoid and a coiled spring. The pressing mechanism may be constituted of a link mechanism or a cam mechanism or any other mechanism which can press the thermal head 20 against the platen drum 10 at a predetermined pressure. The thermal head 20 is driven in accordance with head drive data which is generated from a print controller 52 under the control of the system controller 16. The head drive data is constituted of bias data and image data, as set forth later.

The first optical fixing device 21 has an ultraviolet lamp 21*a* extending in the main scan direction and having an emission center at wave length of 365 nm for fixing the magenta coloring layer 7, whereas the second optical fixing device 22 has an ultraviolet lamp 22*a* extending in the main scan direction and having an emission center at wave length of 420 nm for fixing the yellow coloring layer.

The color thermosensitive recording sheet 4 is fed or discharged through the sheet feed/discharge path 25. A separation claw 27 is formed at the sheet feed/discharge path 25 on the side of the platen drum 10 so as to guide the trailing end of the color thermosensitive recording sheet 4 when the color thermosensitive recording sheet 4 is discharged. In this embodiment, the feed/discharge path 25 is used for both feeding and discharging, but two paths may be provided separately. If a sheet discharge path is separately provided, the platen drum 10 is rotated in the same direction as that of printing when discharging the color thermosensitive recording sheet 4 while releasing the color thermosensitive recording sheet 4 from the clamper 14, although the platen drum 10 is rotated in the opposite direction to that of printing.

A home position sensor 29 is mounted near at the circumference of the platen drum 10. The home position sensor 29 outputs a home position signal to the system controller 16 each time the sensor 29 detects the clamper 14, e.g., a leading edge of the clamper 14 in a normal rotating direction of the platen drum 10 as shown by an arrow. Initially, the platen drum 10 is in the home position, and the clamper 14 located under the home position sensor 29 is set at a clamping release state. When a leading end of the color thermosensitive recording sheet 4 is inserted under the clamper 14, the clamper 14 clamps to secure the leading end of the color thermosensitive recording sheet to the platen drum 10.

Figure 4:
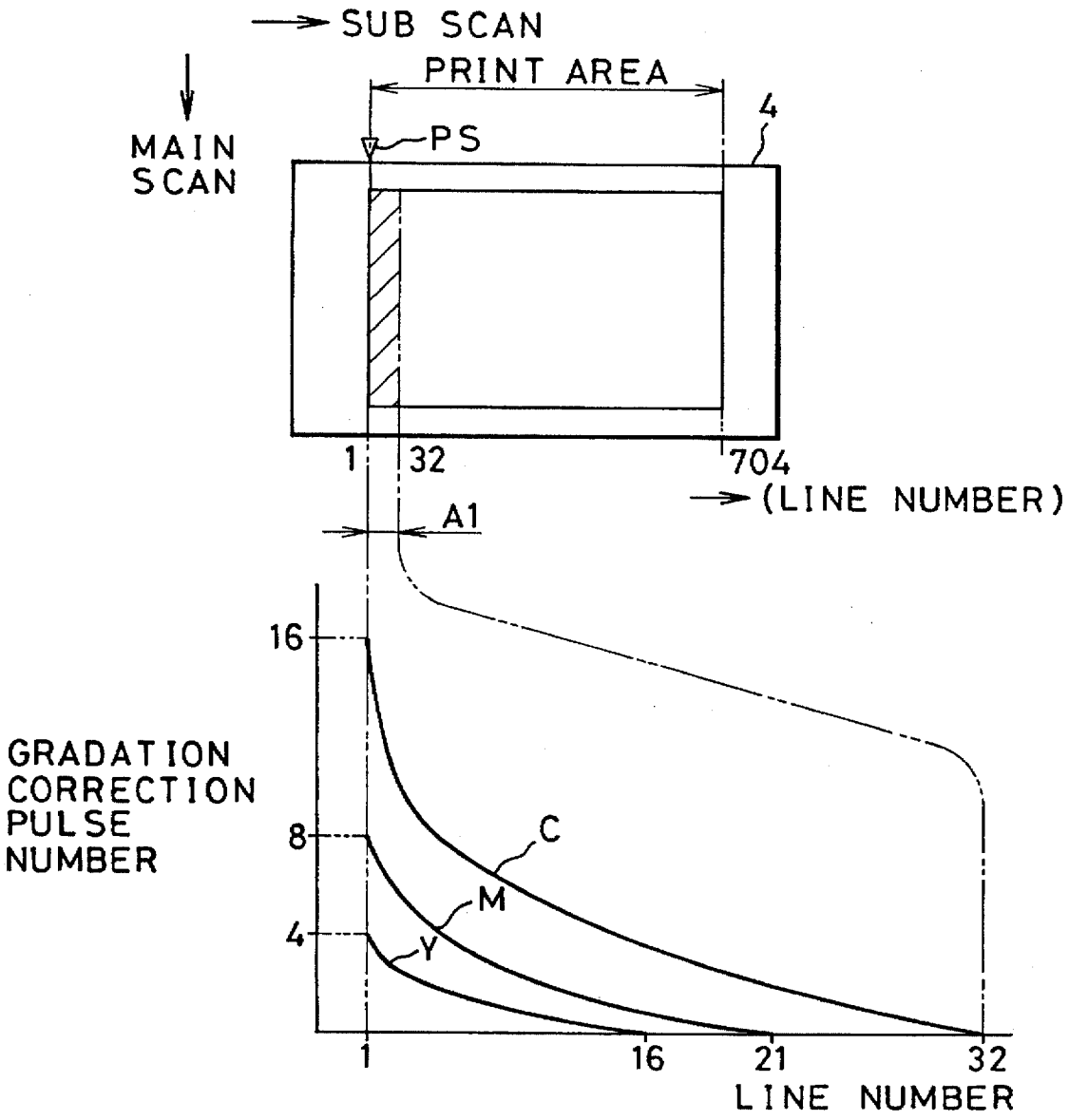
FIG. 4 is an explanatory view for illustrating a density rising correction method using gradation correction pulses.

The system controller 16 is constructed of a known microcomputer, and sequentially controls each circuit portion of the printer to print a color image by three color frame sequential printing. The system controller 16 has a memory 32 which stores the bias data for applying the respective bias heat energies BY, BM and BC to the color thermosensitive recording sheet 4 in printing the respective colors. Also, the system controller 16 performs a density rising correction for improving a density rising property in a predetermined print start area A1, as set forth in detail below. In an embodiment, as shown in FIG. 4, a total print area has a length corresponding to 704 lines in the subsidiary scan direction, including the print start area A1 of 32 lines. The length of the print start area A1 is variable depending on the type of the printer and the color thermosensitive recording sheet and other factors.

Figure 5:
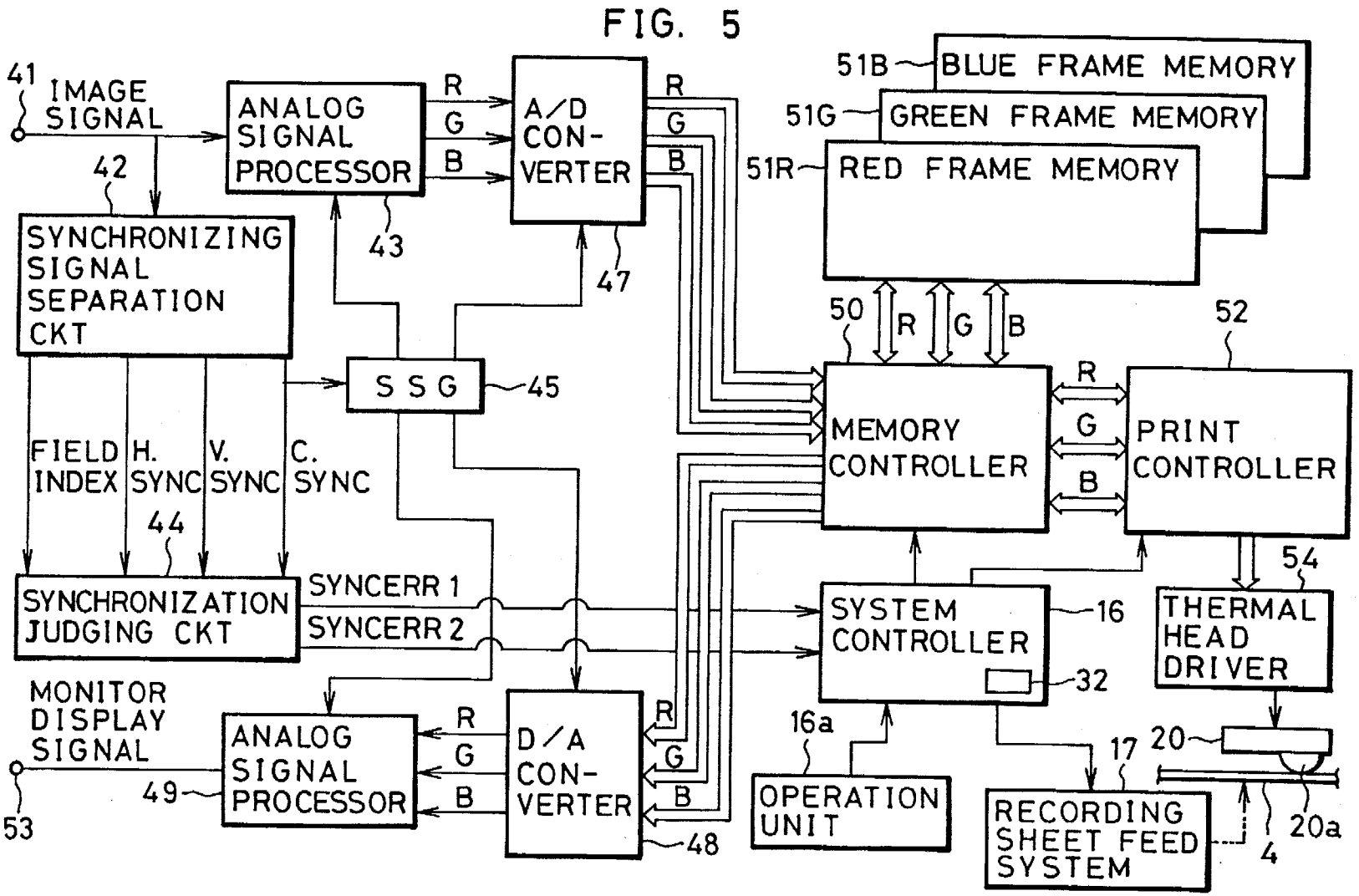
FIG. 5 is a block diagram showing the circuitry of the direct color thermal printer.

FIG. 5 is a circuit block diagram of the direct color thermal printer. A video camera, a VTR, a still video player, a TV game machine, or the like is connected to an input terminal 41, to input a halftone image signal through the input terminal 41 to a synchronizing signal separation circuit 42 and an analog signal processor 43. The synchronizing signal separation circuit 42 separates a composite synchronizing signal (C.SYNC) from the input video signal, and separates a vertical synchronizing signal (V.SYNC) and a horizontal synchronizing signal (H.SYNC) from the composite synchronizing signal. The synchronizing signal separation circuit 42 has an internal horizontal synchronizing signal generator and outputs a horizontal synchronizing signal if it cannot be separated from the composite synchronizing signal. The synchronizing signal separation circuit 42 sends the composite, vertical and horizontal synchronizing signals of an H or L level to a synchronization judging circuit 44, and also sends the composite synchronizing signal to an SSG (synchronizing signal generator) 45.

The synchronizing signal separation circuit 42 generates a field index signal in accordance with the phase relationship between the vertical and horizontal synchronizing signals. If an NTSC standard television signal is applied to the input terminal 41, the phase relationship between the vertical and horizontal synchronizing signals changes between odd and even fields. At that time, the level of the field index signal is inverted every field. If a video signal having only even or odd fields is applied to the input terminal 41, the phase relationship between the vertical and horizontal synchronizing signals will not change so that the field index signal has the same level. The field index signal is sent to the synchronization judging circuit 44.

At the timing of the composite synchronizing signal sent from the synchronizing signal separation circuit 42, SSG 45 controls an analog signal processor 43, an A/D converter 47, a D/A converter 48, and another analog processor 49. The analog signal processor 43 separates the inputted image signal into a red (R) signal, a green (G) signal, and a blue (B) signal, and outputs these color signals after adjusting their levels. Each color signal is sampled at each pixel by the A/D converter 47, and converted into digital data. The obtained red, green and blue image data is sent to a memory controller 50.

A red frame memory 51R, a green frame memory 51G and a blue frame memory 51B are memories for storing image data of "odd" and "even" fields while alternately disposing the scan lines of an odd field with the scan lines of an even field. The read/write of the image data is controlled by the memory controller 50.

An operation unit **16*a* is connected to the system controller 16, and is operable to input one of "through", "print" and "freeze" commands to the system controller 16. The operation unit 16*a* is provided with a field switch for selecting either "odd field" or "even field", and a mode switch for selecting either "frame mode" or "field mode". The system controller 16 controls the memory controller 50 for image data read/write from/to the frame memories 51R, 51G and 51B. The system controller 16 also controls the recording sheet feed system 17 to feed the color thermosensitive recording sheet 4**.

If the frame mode is selected when writing image data, the memory controller 50 writes image data of even and odd fields in the frame memories 51R, 51G and 51B. If the field mode is selected, the memory controller 50 writes image data of even or odd fields and, thereafter, performs an interpolation to write frame image data into the frame memories 51R, 51G and 51B.

In a monitor mode, the memory controller 50 reads image data from the frame memories 51R, 51G and 51B and sends it to the D/A converter 48. In a print mode, the memory controller 50 reads image data one line after another from the frame memories 51R, 51G and 51B and sends it to a print controller 52.

A monitor system is constituted of the D/A converter 48 and the analog signal processor 49. The D/A converter 48 converts three color image data into analog RGB signals and sends them to the analog signal processor 49 which converts the analog RGB signal into NTSC image signals to display frame images on a monitor, e.g., a home TV monitor, connected to an output terminal 53.

A print system is constituted of the print controller 52, a thermal head driver 54, and the thermal head 20. The print controller 52 performs a masking process of three color image data and converts the image data into yellow, magenta and cyan image data. Of these three color image data, one to be printed, the yellow image data for instance, is read one line after another and sent to the thermal head driver 54. Alternately with the image data of one line, bias data corresponding to the predetermined bias heat energy BY, BM or BC for the color to be printed at present, is sent from the system controller 16 to the thermal head driver 54 through the print controller 52, in form of head drive data.

Figure 6:
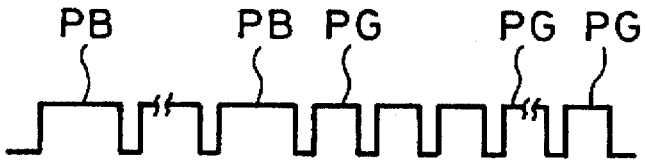
FIG. 6 shows a waveform of a drive pulse signal supplied to a heating element for recording in one pixel.

Based on the head drive data, the thermal head driver 54 applies a drive pulse signal consisting of a variable number of bias pulses PB and image pulses PG, as shown in FIG. 6, to each heating element **20*a* so as to record an ink dot in a pixel at a density corresponding to the image data. After a line of the image is thus recorded, the platen drum 10 is rotated a regular amount to feed the color thermosensitive recording sheet 4 by a distance corresponding to one line or one pixel in the subsidiary scan direction. In this way, the image is recorded one line after another in the print area on the color thermosensitive recording sheet 4. Although the bias pulse PB has a larger width than that of the image pulse PG in the embodiment shown in FIG. 6**, the pulses PB and PG may have the same width. Each pulse PB or PG may consist of a pulse string of plural sub-pulses.

In the beginning of the thermal printing, the system controller 16 accomplishes the density rising correction in the print start area A1 of the print area. That is, a number of drive pulses for rising (increasing) the density are added during printing in the print start area A1. According to an embodiment shown in FIG. 4, a number of gradation correction pulses CG are added to the image pulses PG in the print start area A1. The number of gradation correction pulses CG to be added varies depending on the number of recorded lines in accordance with a function which is predetermined for each color, as shown in FIG. 4, on the basis of experiments and other known data. The number of gradation correction pulses CG decreases as the line number increases. In this embodiment, since the print start area A1 corresponds to 32 lines, the number of gradation correction pulses CG falls down to zero at the 32rd line for the cyan printing.

Also, the number of gradation correction pulses CG is the higher for the coloring layer which requires the higher heat energy to develop, with respect to the same line number. For example, as to the first line, four gradation correction pulses CG are added in the yellow printing, while eight gradation correction pulses CG are added in the magenta printing, and sixteen gradation correction pulses CG are added in the cyan printing. Starting from these pulse numbers, the number of gradation correction pulses falls down to zero at the sixteenth line for the yellow printing, and at the 21st line for the magenta printing.

Figure 7:
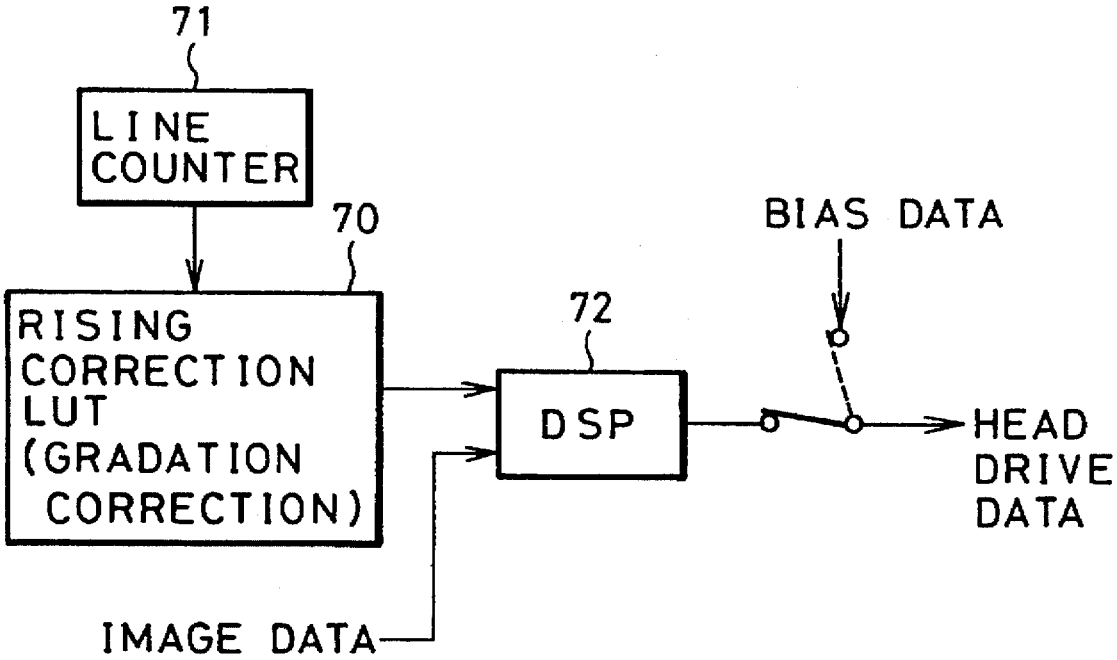
FIG. 7 is a functional block diagram of a density rising correcting section for use in the embodiment shown in FIG. 4.
Figure 8:
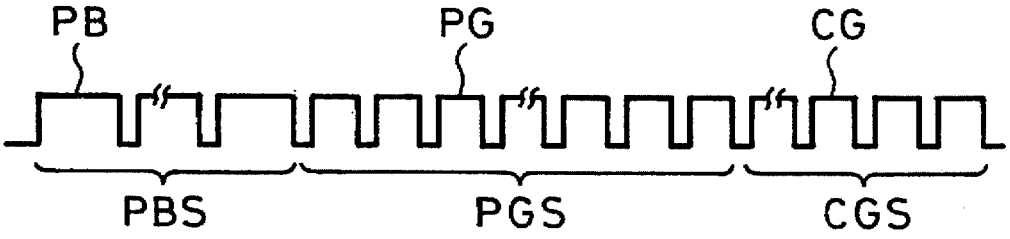
FIG. 8 shows a waveform of a corrected drive pulse signal obtained according to the embodiment shown in FIG. 4.
Figure 9:
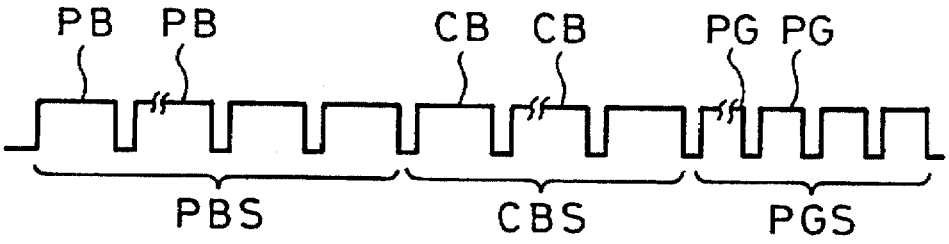
FIG. 9 shows a waveform of a drive pulse signal corrected by adding bias correction pulses according to another embodiment of the invention.
Figure 11:
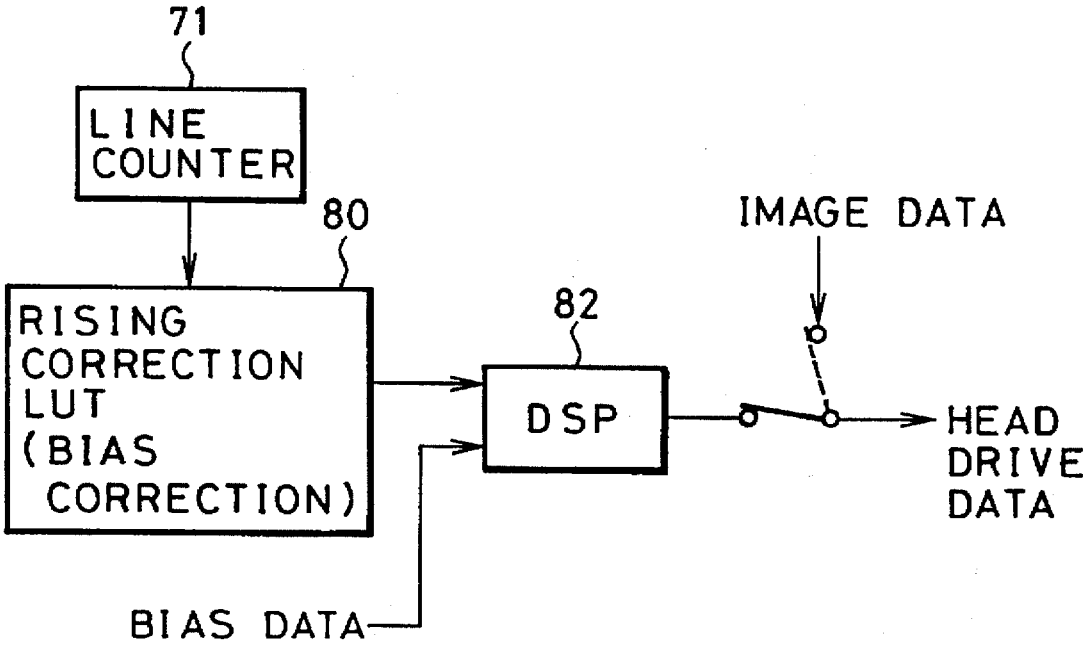
FIG. 11 is a functional block diagram of a density rising correcting section for use in the embodiment shown in FIG. 10.

According to an embodiment shown in FIG. 7, the number of gradation correction pulses allocated to each line for each color is memorized as number data in a look-up table memory (hereinafter referred to as LUT) 70 which is provided in the system controller 16. Also a line counter 71 is provided in the system controller 16 so as to count the recorded lines. Based on the count of the line counter 71, corresponding number data is retrieved from the LUT 70. The number data of gradation correction pulses CG is added to the number data of image pulses PG which is determined for each pixel based on its gradation level J designated by the image data, in a digital signal processor 72 provided in the print controller 52. Accordingly, the thermal head driver 54 generates a drive pulse signal as shown in FIG. 8 within the print start area A1, which includes a string CGS of gradation correction pulses CG of a number designated by the number data, in addition to a bias pulse string PBS and an image pulse string PGS.

It is possible to calculate the number of gradation correction pulses CG in accordance with the correction function for each color, instead of using the look-up table of the correction pulse number data.

Next, the operation of the direct color thermal printer constructed as above will be described. As shown in FIG. 3, while feeding a color thermosensitive recording sheet, the platen drum 10 stops in the home position wherein the clamper 14 is oriented generally vertically. The feed rollers 26 nips the color thermosensitive recording sheet 4 supplied from a cassette (not shown) and feeds it toward the platen drum 10. The feed rollers 26 temporarily stops when the leading end portion of the color thermosensitive recording sheet 4 enters between the platen drum 10 and the clamper 14. After the clamper 14 clamps the leading end portion of the color thermosensitive recording sheet 4, the platen drum 10 and the feed rollers 26 rotate to wind the color thermosensitive recording sheet 4 about the circumferential wall of the platen drum 10.

The pulse motor 12 stepwise rotates the platen drum 10 by one line using four motor drive pulses. Since the one step is very small, the platen drum 10 rotates generally at an equal speed. When it is determined with reference to the count of the motor drive pulses that a leading edge PS of the print area of the color thermosensitive recording sheet 4 is placed under the thermal head 20, thermal printing starts from the first line of a yellow frame. At that time, number data of the gradation correction pulses for the first line of the yellow, i.e., "4" in this instance, is read from the LUT 70 into the DSP 72 in response to the count data from the line counter 72. The number data "4" is added to the number data of the gradation pulse PG which is determined for each pixel in accordance with the image data.

Thus, the print controller 52 applies head drive data representative of the number of bias pulses PB and the number of image pulses PG plus gradation correction pulses CG to the thermal head driver 54, which then generates a corrected drive pulse signal consisting of a bias pulse string PBS, a image pulse string PGS and a correction pulse string CGS as shown in FIG. 8. As a result, each heating element 20*a* of the thermal head 20 is driven to generate a sufficient amount of heat energy enough for recording at desired density right from the first line, though the heating elements 20*a* are cooled so much in the beginning of printing that the sufficient heat energies cannot be generated upon standard or not-corrected drive pulse signals that consist of the bias pulses PB and the image pulses PG, as shown in FIG. 6.

In the same way as for the first line, the number of gradation correction pulses CG for the next line is determined with reference to the LUT 70, and is added to the number of image pulses PG determined for each pixel, so as to drive the heating element 20*a* with the thus corrected drive pulse signal within the print start area A1, e.g., in the 1 to 16 lines for the yellow printing. Thereafter, since no gradation correction pulse CG is added to the image pulses PG, the thermal elements 20*a* are driven by standard drive pulse signals. In this way, density rising characteristics in the print start area A1 is improved.

When the portion of the color thermosensitive recording sheet 4 having the yellow frame recorded thereon faces the optical fixing device 22, the ultraviolet rays from the optical fixing device 22 decomposes diazonium salt compound remaining in the yellow coloring layer 8, so that the yellow coloring layer 8 is disabled from coloring and thus optically fixed. After the thermal recording of the yellow and the optical fixing of the yellow coloring layer are accomplished to a trailing end of the print area, the platen drum 10 is rotated at a higher speed than during printing, so as to rapidly position the leading edge PS of the print area under the thermal head 20. Then, the platen drum 10 is rotated again at the printing speed, while the magenta printing is performed in the same way as for the yellow printing. Also in the magenta printing, the heating elements 20*a* are driven in accordance with corrected drive pulse signals within the print start area A1, i.e., in the 1 to 21 lines in this instance, by adding 8 to 0 gradation correction pulses CG to the image pulses PG. Therefore, density rising characteristics of magenta is also improved.

After the magenta thermal recording, the magenta coloring layer 7 is optically fixed by the optical fixing device 21 in the same way as for the yellow coloring layer 8. Thereafter, cyan printing is performed in the same way, while adding 16 to 0 gradation correction pulses CG to the image pulses PG in the 1 to 32 lines in accordance with the number data memorized in the LUT 70. Since the density rising correction is thus performed taking account of the difference in the necessary coloring heat energies between the three coloring layers 6, 7 and 8, an optimum gray balance can be achieved also in the print start area A1.

After the completion of the three color printing, the platen drum 10 and the feed rollers 26 are rotated reversely, so the trailing end of the color thermosensitive recording sheet 4 is guided by the separation claw 27 into the feed/discharge path 25, to be nipped between the feed rollers 26. Then, the clamper 14 releases the leading end of the color thermosensitive recording sheet 4, so the sheet 4 is discharged through the feed/discharge path 25 onto a not-shown tray or the like.

Because the number data for gradation correction pulses may be stored as table data in the system controller 16, the density rising correction may be effected without the need for modifying the circuitry of the direct color thermal printer as shown in FIG. 5.

Since the above-described density rising correction is made by adding correction pulses to image pulses, it would be possible that the memory does not have sufficient capacity enough to add an appropriate number of correction pulses for a maximum density. In that case, the number of image pulses for the maximum density may be determined depending on the memory capacity so as to leave a room for adding correction pulses to the image pulses for the maximum density.

Figure 10:
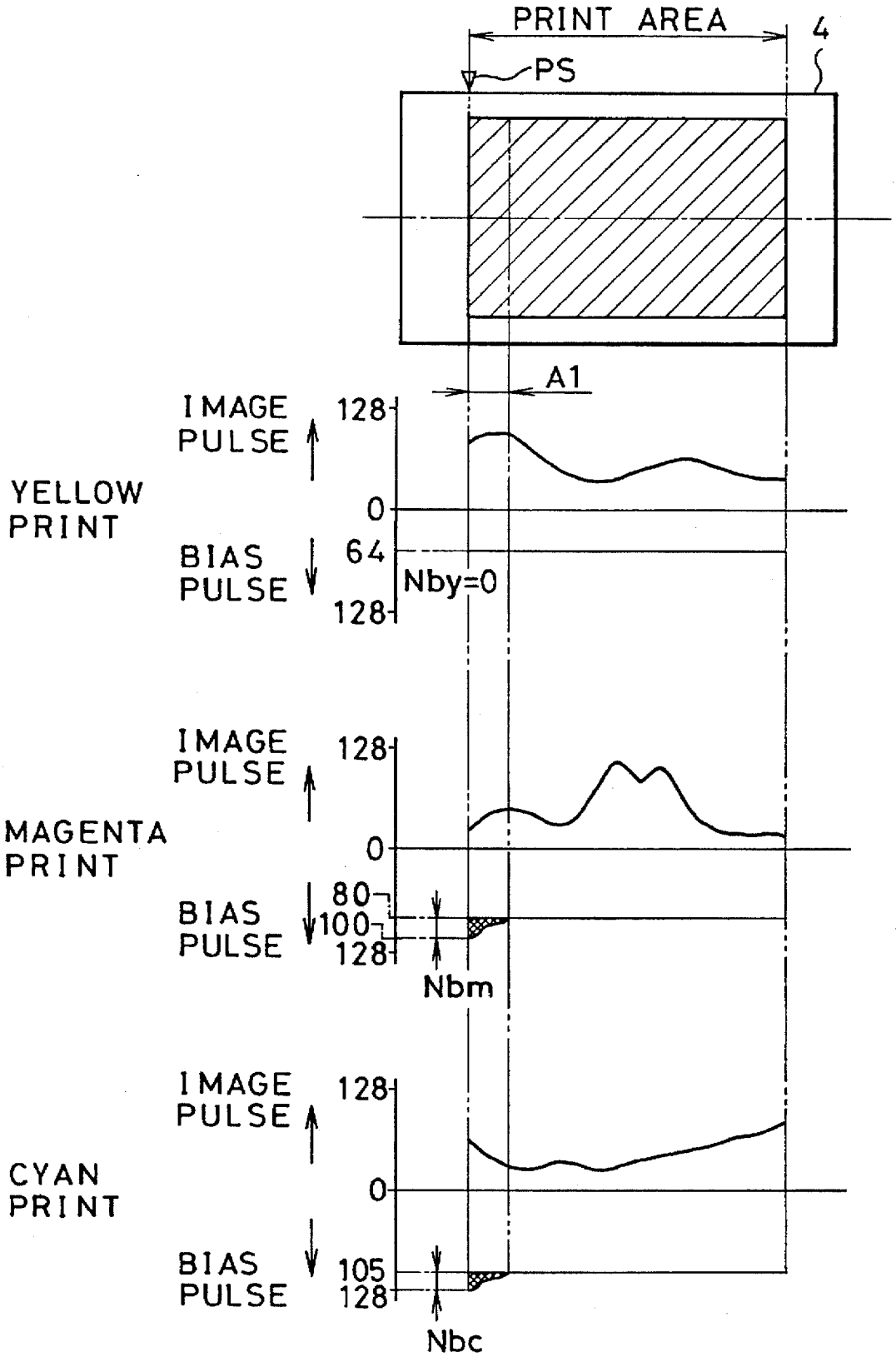
FIG. 10 is an explanatory view for illustrating the embodiment using the bias correction pulses.

It is also possible to add bias correction pulses CB to bias pulses PB of a standard number which is predetermined for each color, so as to control bias heat energy to correct the density rising characteristics. This embodiment enables a sufficient density correction in the maximum density range. FIG. 10 show an example of the number Nby, Nbm, Nbc of bias correction pulses CB to be added to the standard bias pulses PB for each color in each line. As shown, the number Nby for the yellow printing is zero in this example, because it is not always necessary to make density rising correction in the yellow printing, as it requires a smaller coloring heat energy and hence has almost sufficient density rising characteristics. Therefore, in yellow printing, merely a standard bias pulse string PBS of 64 bias pulses PB is used for every line. In magenta printing, a bias correction pulse string CBS of 20 bias correction pulses CB is added to a standard bias pulse string PBS of 80 bias pulses PB for the first line. The number of bias correction pulses CB decreases from 20 to zero as the line number increases from 1 to 32. In cyan printing, a bias correction pulse string CBS of 23 bias correction pulses CB is added to a standard bias pulse string PBS of 105 bias pulses PB for the first to fifth line, and thereafter, the number of bias correction pulses CB gradually decreases to zero at the 32 line.

The number data Nby, Nbm, Nbc for the density rising correction in the bias heating is stored in a density rising correction look-up table (LUT) 80 in the system controller 16. The number data Nby, Nbm, Nbc is retrieved from the LUT 80 in accordance with the count of a line counter 70, and is sent to a digital signal processor (DSP) 82 included in the print controller 52. The DSP 82 adds the number Nby, Nbm, Nbc to the standard number of bias pulses PB, which is represented by the bias data from the memory 32. Thus, corrected bias data is sent alternately with image data to constitute head drive data for the head driver 54.

Also, it is possible to calculate the number of bias correction pulses CB for each color in accordance with a correction function representative of a relationship between the line number and the number of bias correction pulses, instead of using the look-up table of the correction pulse number data.

According to a preferred embodiment of the invention, the system controller 16 performs a preliminary pressed running control in addition to the above-described rising correction. The preliminary pressed running control is intended to reduce the influence of feed fluctuation of the sheet 4 and suppress a color shift or registration error in the subsidiary scan direction. For the preliminary pressed running, the thermal head 20 is pressed against the sheet 4 before the leading edge PS of a print area of the sheet 4 fed in the subsidiary scan direction, and continues to be pressed on the sheet 4, while preheating the sheet 4 at a heat energy equal or less than the bias heat energy for the next coloring layer to be colored, until the leading edge PS of the print area faces the heating elements 20*a*.

In this way, the influence of feed fluctuation of the sheet 4 caused by play or deformation the recording sheet feed system 17 is canceled. Thanks to the preheating during the preliminary pressed running, a thermal equilibrium state is provided between the thermal head 20, the sheet 4 and the platen drum 10 at the leading edge PS, so that almost sufficient coloring density will be obtained right from the start of actual printing. Therefore, combination of the preliminary pressed running control reduces the total amount of density rising correction, and achieves a reliable and stable correction in spite of variation in ambient conditions or that of mechanisms. It is possible to perform a mere preheating control in the preliminary running section in combination with the density rising correction, in order to reduce the amount of density rising correction.

For the preliminary pressed running control, the memory 32 in the system controller 16 is written with preliminary pressed running start position data Pαy, Pαm and Pαc. These data Pαy, Pαm and Pαc represent the numbers of drive pulses of the pulse motor 7 corresponding to the distances αy, αm and αc from a home position HP to the preliminary pressed running start positions Py, Pm and Pc. The home position HP means a position in the sheet 4 where the array of heating elements 20*a* are opposed when the platen drum 10 is positioned in its home position, that is, when the home position sensor 29 generates a home position signal upon detecting the leading edge of the clamper 14. The distances αy, αm and αc are specific to each color and are set to prevent a color registration shift which can be caused by an unstable feed of the sheet 4 immediately after driving the platen drum 10. The feed fluctuation results from an inertia and play of the feed system, a deformation of rubber of the platen drum 10, a change in the friction coefficient between the thermal head 20 and the color thermosensitive recording sheet 4 which is caused by the heat energy during the preliminary pressed running, the thermal expansion/contraction of the color thermosensitive recording sheet 4, the pressing force of the thermal head 20 onto the sheet 4, and the like. The distances αy, αm and αc are predetermined from experiments while considering the whole of the above factors having influence on the feed fluctuation and thus the color registration shift.

In printing a yellow image, the system controller 16 counts the number of motor drive pulses, starting from when the home position signal is detected by the home position sensor 29. When the count becomes Pαy, the thermal head 20 is at the preliminary pressed running start position Py. The system controller 52 actuates the pressing mechanism 23 to press the heating elements 20*a* against the sheet 4. After this pressing, all the heating elements 20*a* are preheated by the same bias drive pulses as for generating the yellow bias heat energy BY, in this instance. This preliminary pressed running operation is executed over a predetermined number of lines. Thereafter, the actual printing of the yellow image is started by applying the bias heat energy BY and image heat energy GYj to the sheet 4. Instead of the preliminary pressed running start position data Pαy, Pαm and Pαc, the memory 32 may store data of "DP-Pαy", "DP-Pαm" and "DP-Pαc", wherein DP represents the number of drive pulses of the pulse motor 12 corresponding to the distance D from the home position HP to the print start position PS.

Also in the magenta printing operation, the number of motor drive pulses is counted from when the home position HP is detected. When the count becomes Pαm, it means that the heating elements 20*a* is at the preliminary pressed running start position Pm. Immediately thereafter, the pressing mechanism 23 is actuated to press the thermal head 20 against the sheet 4, and the heating elements 20*a* are preheated to the magenta bias heat energy BM. The preliminary pressed running operation before the magenta printing is executed over the same number of lines as for the yellow printing. At the end of this preliminary pressed running, the heating elements 20*a* reach the same print start position PS as in the yellow printing. Similarly, in printing the cyan image, the preliminary pressed running operation with the preheating starts from the preliminary pressed running position Pc and ends at the same print start position PS as the other colors. The number of lines, i.e., the number of motor drive pulses, during the preliminary pressed running operation, is the same for each color, and is determined based on the longest shift amount "D-αc" of the preliminary pressed running start positions Py, Pm and Pc from the print start position PS.

Figure 13:
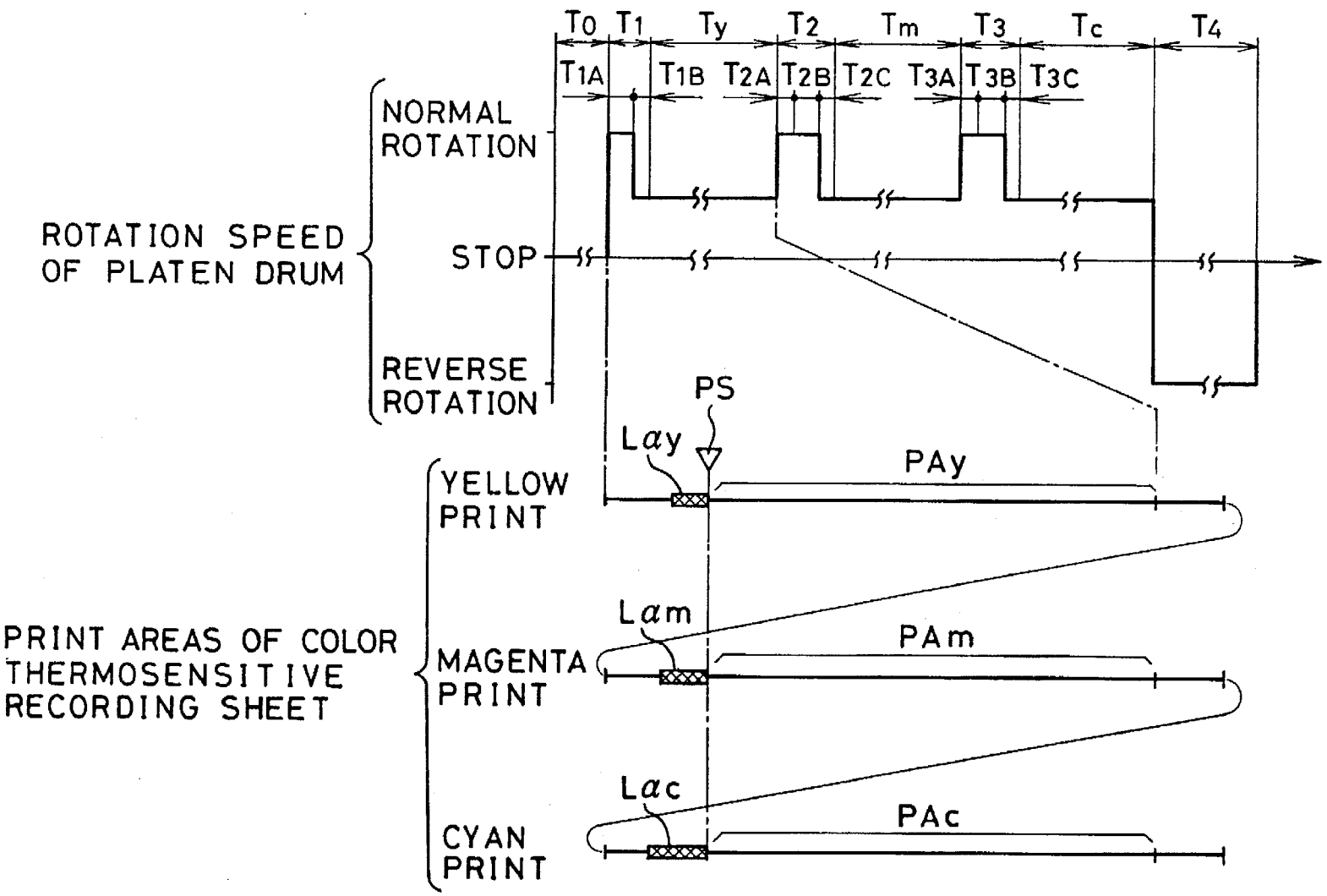
FIG. 13 is a diagram showing the relationship between platen drum rotation and print areas for respective colors.

FIG. 13 shows the relationship between the rotation states of the platen drum 10 and the feed amounts of the sheet 4, wherein To represents a time period from when a print start button is depressed to when the sheet 4 reaches the clamping position (home position HP). During this time period To, the platen drum 10 stays in its home position. T1 represents a time period from when the clamper 14 fixes the leading end portion 4*a* of the sheet 4 to the circumferential wall of the platen drum 10 to when the print start position PS of the sheet 4 reaches the heating element array 20*a*. This time period T1 has a time period T1A during which the platen drum 10 is rotated at the high speed from the home position HP to the preliminary pressed running start position Py, and a preliminary pressed running time T1B during which the platen drum 10 is rotated at the print speed from the preliminary pressed running start position Py to the print start position PS.

Ty represents a time period from the print start of the first line to the completion of the yellow optical fixation. T2 represents a time period during which the print start position PS of the print area PA of the sheet 4 is moved to the heating element array 20*a* after the yellow optical fixation. This time period T2 has a time period T2A during which the sheet 4 is moved to the home position HP by rotating the platen drum 10 at the high speed immediately after the yellow optical fixation, a time period T2B during which the sheet 4 is moved at the high speed from the home position HP to the preliminary pressed running start position Pm, and a preliminary pressed running time period T2C during which the platen drum 10 is rotated at the print speed from the preliminary pressed running start position Pm to the print start position PS.

Tm represents a time period from the magenta image print start to the completion of the magenta optical fixation. T3 represents a time period during which the print start position PS of the print area PA of the sheet 4 is moved to the heating element array 20*a* after the magenta optical fixation. This time period T3 has a time period T3A during which the sheet 4 is moved to the home position HP by rotating the platen drum 10 at the high speed immediately after the magenta optical fixation, a time period T3B during which the sheet 4 is moved at the high speed from the home position HP to the preliminary pressed running start position Pc, and a preliminary pressed running time period T3C during which the platen drum 10 is rotated at the print speed from the preliminary pressed running start position Pc to the print start position PS. A time period Tc represents a cyan image print time, and a time period T4 represents a reverse rotation time for sheet discharge.

Preheating with a bias heat energy of each color is performed in each preliminary pressed running time T1B, T2C, T3C (T1B=T2C=T3C). Because the preliminary pressed running with preheating absorbs the play and the like of the feed system 17, preliminary pressed running sections Lαy, Lαm and Lαc having different lengths (Lαy<Lαm<Lαc) are results, as is shown by cross hatching in FIG. 13, so that the print start positions PS of actual print areas PAy, PAm and PAc of respective colors coincide with each other. Because of the preheating, the heat balance between the thermal head 20 and the sheet 4 as well as the friction coefficients therebetween are set in substantially the same conditions for respective colors, thereby suppressing the feed fluctuation at the start of printing in the print areas PAy, PAm and PAc.

Figure 12:
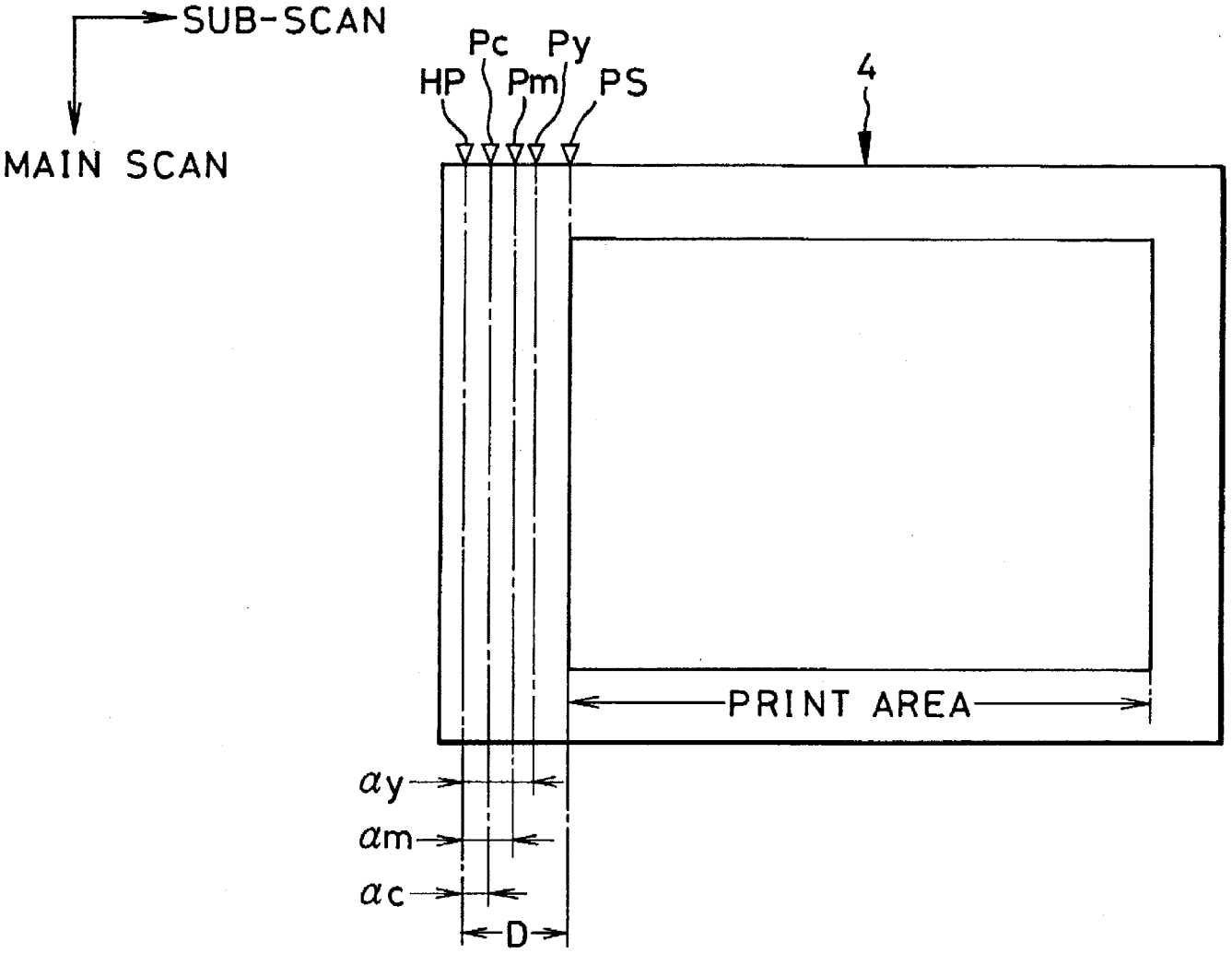
FIG. 12 is a schematic diagram showing the relationship between preliminary pressed running start positions and a print area for respective colors of a color thermosensitive recording sheet.

While the above-described embodiments correct the density rising characteristics by supplementing the image pulses or the bias pulses in the print start area A1, the density rising correction may be made by controlling the voltage applied to the respective heating elements. As shown in FIG. 12, a correction voltage Vcy, Vcm, Vcc, which is specific to each color and decreases with the increase of the line number, is added to a standard voltage Vsy, Vsm, Vsc within a print start area A1, e.g., the area from the 1 to 32 line. The standard voltages Vsy, Vsm, Vsc is also specific to the color, and decreases proportionally with the increase of the line number, as is implied by phantom lines in FIG. 14.

Figure 14:
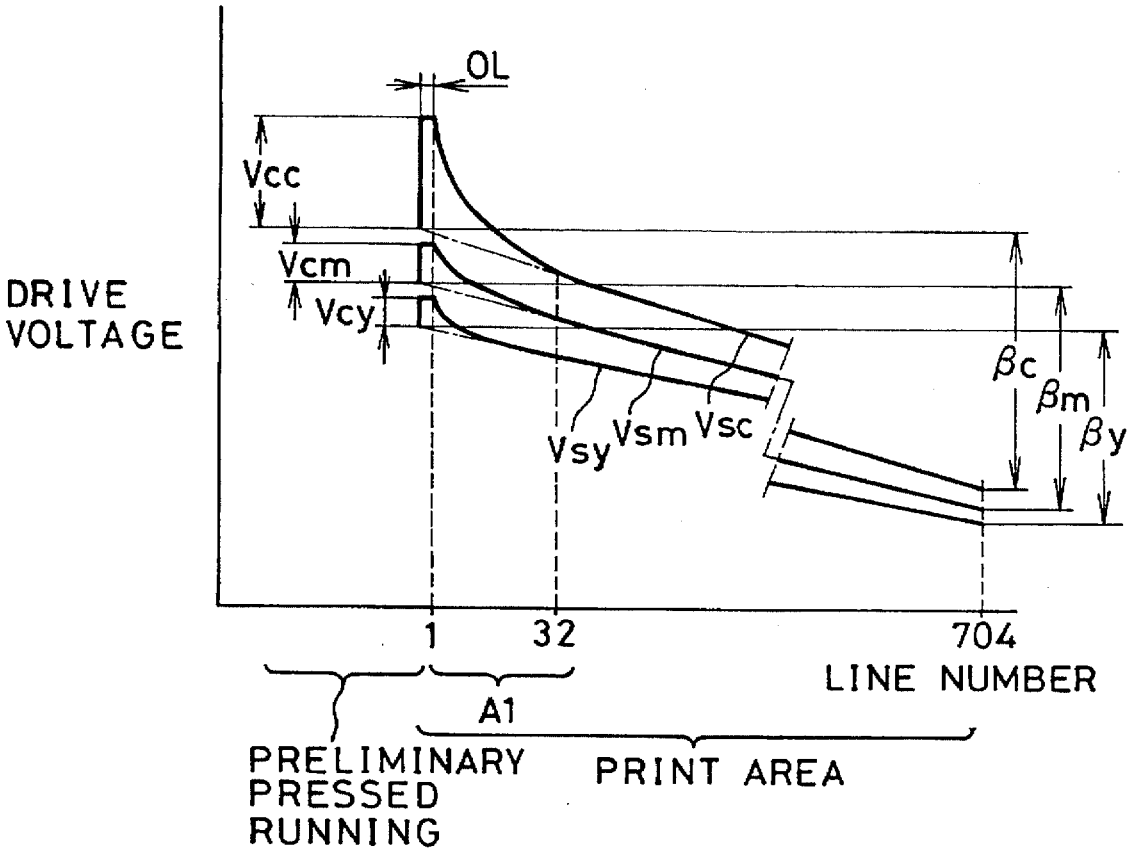
FIG. 14 is a graph illustrating the relationship between drive voltages and the numbers of lines according to another embodiment of the invention.
Figure 15:
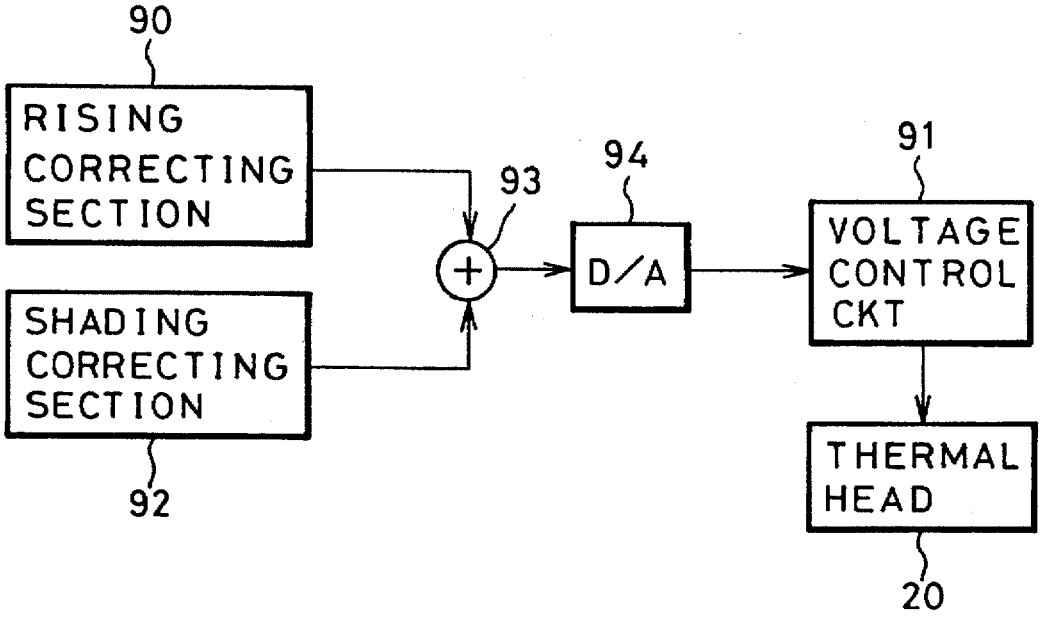
FIG. 15 is a functional block diagram of a density rising- and shading correcting section for use in the embodiment shown in FIG. 14.

As show in FIG. 15, this voltage correction control is performed through a rising correcting section 90 and a voltage control circuit 91 which may be included in the system controller 16, in accordance with correction amounts stored as table data in a table memory or calculated by using a function in an operation circuit. Since the voltage control circuit 91 has a response time, the starting time of the voltage correction is determined so as to compensate for the delay in response. According to the embodiment shown in FIG. 14, the starting time of the correction is set with an offset amount OL of three lines. Therefore, the voltage correcting operation is started three lines before the leading edge of the print area, thereby to obtain an appropriate correction voltage exactly from the leading edge of the print area.

As shown in FIG. 14, the above-described preliminary pressed running control is made also in this embodiment. In the preliminary pressed running period, the correction voltages Vcy, Vcm and Vcc as well as the standard voltages Vsy, Vsm and Vsc are maintained unchanged in each color. The proportional decrease of the standard voltages Vsy, Vsm and Vsc is intended to be a shading correction for preventing "shading" in an image which could be caused by heat accumulation in the thermal head 20. A shading correcting section 92 is provided for this purpose, and the density rising correction amount is added to the shading correction amount in an adder 93 before being sent to the voltage control circuit 91. According to the embodiment shown in FIG. 14, the standard voltage Vsc, Vsm, Vsy decreases by an amount βc, βm, βy from the start to the end of printing in a print area consisting of 704 lines.

Thus, the voltage control for density rising correction can be performed by the same voltage control circuit 91 as used for the shading correction, although the density rising correction is effected in the print start area, while the shading correction is effected over the whole print area. Therefore, this embodiment can be realized with a simple circuit construction.

Still more fine density rising correction may be made by combining two or three of the above-described embodiments.

In the above embodiments, a recording sheet is wound about a platen drum. The invention is applicable to the case where a plurality of feed roller pairs are disposed in a straight sheet path to transport the recording sheet. At that time, optical fixing devices may be disposed on opposite sides of a thermal head along the straight sheet path, and the recording sheet may be moved reciprocally for printing a full-color image. The invention is also applicable to a printer having three thermal heads with two optical fixing devices disposed therebetween so as to print a full-color image through one rotation or one way movement of the recording sheet. Furthermore, the platen drum 10 may be continuously rotated by an DC motor instead of the pulse motor 12. In alternative, a thermal head may move in the subsidiary scan direction during printing. The present invention is also applicable to a serial printer wherein a thermal head moves in the subsidiary scan direction while a recording sheet is transported in the main scan direction relative to the thermal head.

Although the present invention has been described with reference to the preferred embodiments shown in the drawings, the invention should not be limited by the embodiments but, on the contrary, various modification of the present invention can be effected without departing from the spirit and scope of the appended claims.

What is claimed is:

1. A direct color thermal printing method for printing a full-color image on a color thermosensitive recording sheet with at least a thermal head, said color thermosensitive recording sheet having at least three thermosensitive coloring layers including a yellow thermosensitive coloring layer, a magenta thermosensitive coloring layer and a cyan thermosensitive coloring layer, respectively formed on a base, said thermosensitive coloring layers having heat sensitivities increasing in accordance with an order of said thermosensitive coloring layers to a top of said color thermosensitive recording sheet, said thermosensitive coloring layers being colored downwardly from the top of said color thermosensitive recording sheet in frame-sequential fashion, and said thermal head having a plurality of heating elements arranged along a main scan direction, the direct color thermal printing method comprising the steps of:

providing a relative motion between said thermal head and said color thermosensitive recording sheet in a subsidiary scan direction perpendicular to said main scan direction;

selectively heating said plurality of heating elements at a variable heat energy during said relative motion to print color frames, constituting said full color image, sequentially in said color thermosensitive coloring layers; and adding supplementary heat energy to said variable heat energy from a print start position of each of said color frames over a predetermined number of subsidiary scan lines, said supplementary heat energy decreasing as the subsidiary scan line number increases, and increasing as the heat sensitivities of said thermosensitive coloring layers decrease.

2. The direct color thermal printing method according to claim 1, wherein said variable heat energy is a sum of a bias heat energy having a level and below a coloring threshold and an image heat energy for coloring a pixel at a desired density, said bias heat energy being determined in accordance with the heat sensitivity of each of said thermosensitive coloring layers.

3. The direct color thermal printing method according to claim 2, wherein said bias heat energy and said image heat energy are generated by a first number of bias pulses and a second number of image pulses, respectively, supplied to each of said plurality of heating elements, said first number of bias pulses being predetermined for each of said thermosensitive coloring layers, said second number of image pulses varying depending on the desired coloring density of the input image signal.

4. The direct color thermal printing method according to claim 3, wherein said supplementary heat energy is generated by adding a third number of pulses to said second number of said image pulses, to supplement said image heat energy to achieve the desired coloring density of the input image signal.

5. The direct color thermal printing method according to claim 3, wherein said supplementary heat energy is generated by adding a third number of pulses to said first number of said bias pulses, to supplement said bias heat energy to achieve the desired coloring density of the input image signal.

6. The direct color thermal printing method according to claim 2, wherein said supplementary heat energy is generated by increasing voltage supplied to said heating elements by a predetermined amount to achieve the desired coloring density of the input image signal.

7. The direct color thermal printing method according to claim 2, wherein said supplementary heat energy is determined in accordance with a function, predetermined based upon each of said color thermosensitive coloring layers and based upon each subsidiary scan line number.

8. The direct color thermal printing method according to claim 7, wherein said supplementary heat energy is added over a relatively larger number of lines, for relatively lower heat sensitivity thermosensitive coloring layers to be colored.

9. The direct color thermal printing method according to claim 2, further comprising the steps of:

pressing said thermal head against said color thermosensitive recording sheet when said thermal head reaches a preliminary running section preceding said print start position of each color frame during said relative motion;

preheating said plurality of heating elements at a preheat energy in said preliminary pressed running section, said preheat energy being equal to or less than said bias heat energy of each of said thermosensitive coloring layers and decreasing as the heat sensitivities of said thermosensitive color layers increase; and determining length of said preliminary pressed running section in said subsidiary scan direction for each color frame, such that said length increases as said preheat energy increases, while taking into account friction between said thermal head and said thermosensitive recording sheet that decreases as the preheat energy increases, so that said print start position of each color frame coincides with each other.

10. The direct color thermal printing method according to claim 9, wherein said yellow thermosensitive coloring layer is an uppermost layer of said color thermosensitive recording sheet and said cyan thermosensitive coloring layer is a lowermost layer.

11. The direct color thermal printing method according to claim 10, further comprising the steps of:

optically fixing said yellow thermosensitive coloring layer by ultraviolet radiation of a first wavelength range, immediately after being printed, and optically fixing said magenta thermosensitive coloring layer by ultraviolet radiation of a second wavelength range, immediately after being printed.

12. The direct color thermal printing method according to claim 11, wherein said color thermosensitive recording sheet is wound on a periphery of a rotatable platen drum, and said thermal head is disposed in a circumferential position of said platen drum with said heating elements aligned in an axial direction of said platen drum.

13. The direct color thermal printing method according to claim 12, further comprising the step of:

printing each line of the image on said color thermosensitive recording sheet after said platen drum is intermittently rotated by a predetermined distance.

14. The direct color thermal printing method of claim 8, wherein said yellow thermosensitive coloring layer is an uppermost layer of said color thermosensitive recording sheet and said cyan thermosensitive coloring layer is a lowermost layer.

* * * * *